US005157978A

United States Patent [19]

Morishita et al.

[11] Patent Number: 5,157,978

[45] Date of Patent: Oct. 27, 1992

[54] STARTER APPARATUS WITH PLANETARY SPEED REDUCTION GEAR

[75] Inventors: Akira Morishita; Toshinori Tanaka; Kyoichi Okamoto, all of Himeji, Japan

[73] Assignee: Mitsubishi Denki K.K., Tokyo, Japan

[21] Appl. No.: 892,628

[22] Filed: Jun. 2, 1992

Related U.S. Application Data

[63] Continuation of Ser. No. 615,956, Nov. 20, 1990, abandoned.

[30] Foreign Application Priority Data

Nov. 21, 1989 [JP] Japan ..... 1-300816

[51] Int. Cl.[5] ..... F02N 15/06

[52] U.S. Cl. ..... 74/7 E; 74/7 R; 74/DIG. 10

[58] Field of Search ..... 74/7 E, 7 R, DIG. 10

[56] References Cited

U.S. PATENT DOCUMENTS

| | | | |
|---|---|---|---|
| 4,494,414 | 1/1985 | Hamano | 74/7 E |
| 4,651,575 | 3/1987 | Morishita et al. | 74/DIG. 10 X |
| 4,680,979 | 7/1987 | Morishita et al. | 74/7 E |
| 4,712,451 | 12/1987 | Morishita et al. | 74/DIG. 10 X |
| 4,715,243 | 12/1987 | Morishita et al. | 74/DIG. 10 X |
| 4,776,225 | 10/1988 | Morishita et al. | 74/7 E |
| 4,848,172 | 7/1989 | Morishita | 74/7 E |
| 4,951,515 | 8/1990 | Morishita et al. | 74/7 E |

FOREIGN PATENT DOCUMENTS

| | | |
|---|---|---|
| 188126 | 7/1986 | European Pat. Off. . |
| 2184787 | 7/1987 | United Kingdom . |

*Primary Examiner*—Leslie A. Braun
*Assistant Examiner*—Julie Krolikowski
*Attorney, Agent, or Firm*—Sughrue, Mion, Zinn, Macpeak & Seas

[57] ABSTRACT

An engine starter apparatus comprises a housing (9), a d.c. electric motor (2), an output rotary shaft (3) with a pinion (7), and a planetary speed reduction gear (5). The planetary speed reduction gear (5) comprises a sun gear (11), an internal gear (20), a plurality of planetary gears (12) disposed between the sun gear (11) and the internal gear (20), and a planetary gear carrier (10) connected to the output rotary shaft (3) for rotatably supporting the planetary gears (12). The internal gear (20) comprises a ring-shaped internal gear member (20*a*), and elastic reinforcing ring member (21,22; 24) for elastically supporting the internal gear member (20*a*), thereby to increase rigidity of the internal gear member (20*a*). The reinforcing ring member may comprise a thin-wall cylindrical member (22) concentrically disposed around the internal gear member (20*a*) with an annulus defined therebetween, and a plurality of ribs (21) radially and axially extending through the annulus for integrally connecting them together. The reinforcing ring member may be a solid elastic ring (24). The reinforcing ring member (21,22; 24) may have formed therein an axial groove (23) for allowing a through bolt for connecting the housing and the d.c. motor to pass therethrough.

6 Claims, 4 Drawing Sheets

STARTER APPARATUS WITH PLANETARY SPEED REDUCTION GEAR

This is a Continuation of Application No. 07/615,956 filed Nov. 20, 1990, now abandoned.

BACKGROUND OF THE INVENTION

This invention relates to a starter apparatus with a planetary speed reduction gear and, more particularly, to a starter apparatus with a planetary speed reduction gear in which the rotation of a d.c. electric motor is transmitted through a planetary speed reduction gear mechanism to a pinion for driving an engine ring gear.

FIGS. 7 to 9 illustrate a conventional starter apparatus 1 with a planetary speed reduction gear, and the starter apparatus 1 comprises a d.c. electric motor 2, an over-running clutch 4 slidably placed over an output rotary shaft 3 connected to an armature rotary shaft of the d.c. electric motor 2 and a planetary speed reduction gear mechanism 5 which transmits, after speed-reducing, the rotational force of the armature rotary shaft through the output rotary shaft 3 to a clutch outer member of the over-running clutch 4. A shift lever 6 is provided to be driven by an unillustrated solenoid switch to cause a pinion 7 mounted to the output rotary shaft 3 to engage and disengage with respect to the engine ring gear.

The planetary speed reduction gear mechanism 5 comprises an internal gear 10 made of a resin material and mounted to a housing 9 disposed on a front bracket 8, a spur gear 11 mounted to an armature rotary shaft and a plurality of planetary gears 12 in engagement with the internal gear 10 and the spur gear 11, and a planetary gear carrier 13 pivotally supporting the planetary gears 12 is connected to the output rotary shaft 3. Disposed between the d.c. motor 2 and the internal gear 10 is a packing 14.

With the above conventional starter apparatus, the rotation of the armature rotary shaft is transmitted from the spur gear 11 to the planetary gears 12 and is speed-reduced by the planetary speed reduction gear mechanism 5 to be transmitted to the over-running clutch 4. Therefore, the pinion 7 which is in engagement with the over-running clutch 4 is rotated and moved forward to engage and drive an unillustrated engine ring gear.

In the conventional planetary speed reduction gear starter apparatus as above-described, the internal gear deforms into a shape approximating a polygon having a number of sides corresponding to the number of planetary gears when a massive load is applied to the planetary speed reduction gear mechanism. Under such circumstances, the engagement between the planetary gears and the internal gear is shallow and the contact surface pressure is increased, so that the teeth of the gears are broken and the dedendum stress is increased because of the concentrated load on the tip of each tooth.

SUMMARY OF THE INVENTION

Accordingly, one object of the present invention is to provide a starter apparatus with a planetary speed reduction gear free from the above discussed problems of the conventional design.

Another object of the present invention is to provide a starter apparatus with a planetary speed reduction gear in which an internal gear of the planetary speed reduction gear does not disadvantageously deform with a large load.

Another object of the present invention is to provide a starter apparatus with a planetary speed reduction gear in which an undesirable effect of heat generated within the planetary speed reduction gear is eliminated.

With the above objects in view, the engine starter apparatus of the present invention comprises a housing, a d.c. electric motor attached to the housing and having an armature rotary shaft, an output rotary shaft with a pinion engageable with an engine ring gear, and a planetary speed reduction gear disposed within the housing between the armature rotary shaft and the output rotary shaft. The planetary speed reduction gear comprises a sun gear mounted to the armature rotary shaft, an internal gear made of a resin material and concentrically disposed around the sun gear with an annular space defined therebetween, a plurality of planetary gears disposed between the sun gear and the internal gear and each engaged with the sun gear and the internal gear, and a planetary gear carrier connected to the output rotary shaft and rotatably supporting the planetary gears. The internal gear comprises a ring-shaped internal gear member having an inner circumferential surface and an outer circumferential surface, and a reinforcing member for elastically supporting the outer circumferential surface of the internal gear member, thereby to increase rigidity of the internal gear member.

In one embodiment, the reinforcing member comprises a thin-wall, substantially cylindrical member concentrically disposed around the internal gear member with an annulus defined therebetween, and a plurality of ribs radially and axially extending between the outer circumferential surface of the internal gear member and the cylindrical member for integrally connecting them together. Each of the ribs has a thickness which is substantially equal to a thickness of the thin-wall cylindrical member and smaller than a radial dimension of the internal gear member between the dedendum circle of the internal gear and the outer circumferential surface of the internal gear member. The thin-wall cylindrical member and the housing may define therebetween a small radial gap which preferably is from 0.1% to 0.5% of an outer diameter of the internal gear member. The ribs and the thin-wall cylindrical member have an axial length sufficient for covering at least an axial length corresponding to one half of an axial length of a meshing area in which the planetary gears are in mesh with the internal gear member, and a packing material may be filled between the other half of the axial length of the meshing area of the internal gear member and the housing.

In another embodiment, the reinforcing member may be an elastic ring member disposed between the outer circumferential surface of the internal gear member and the housing.

According to the present invention, the internal gear has a greater rigidity due to an elastic reinforcing member which may be ribs and a thin cylinder integrally molded to the internal gear member or an elastic packing material, so that the internal gear is prevented from being deformed even when a massive load is applied.

BRIEF DESCRIPTION OF THE DRAWINGS

The present invention will become more readily apparent from the following detailed description of the preferred embodiment of the present invention taken in conjunction with the accompanying drawings, in which:

FIGS. 7~9 illustrate a conventional planetary gear type speed reduction starter apparatus, in which FIG. 7 is a partial side view of a conventional starter apparatus with a planetary speed reduction gear;

FIG. 8 is a perspective exploded view of the main parts of the starter apparatus illustrated in FIG. 7; and FIG. 9 is a schematic front view of the main portion of the starter apparatus illustrated in FIG. 7.

DESCRIPTION OF THE PREFERRED EMBODIMENTS

Figure 1:
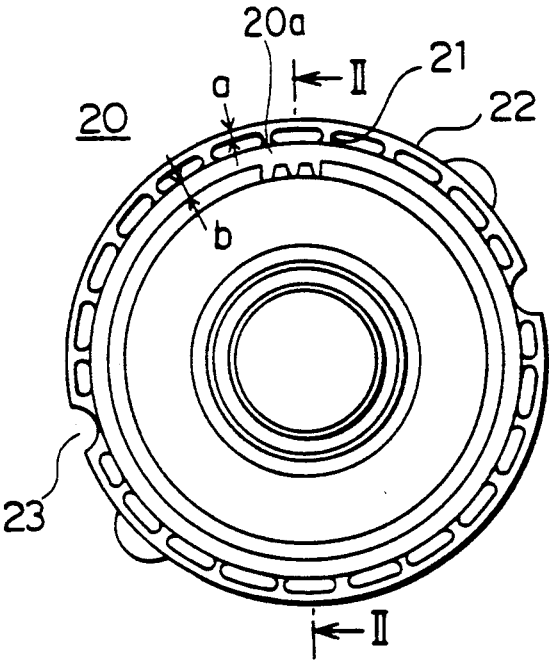
FIG. 1 is a front view of the main portion of one embodiment of the starter apparatus with a planetary speed reduction gear of the present invention.
Figure 2:
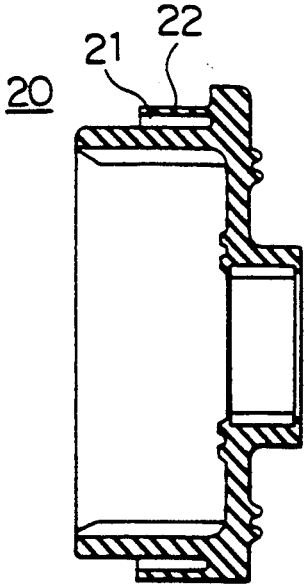
FIG. 2 is a sectional view taken along line II—II of FIG. 1.
Figure 3:
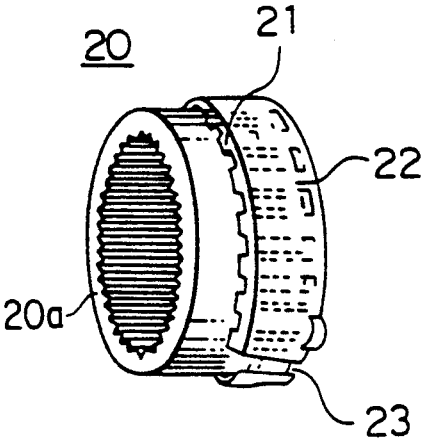
FIG. 3 is a perspective view of the main portion shown in FIGS. 1 and 2.

FIGS. 1 to 4 illustrate one embodiment of the present invention, in which an engine starter apparatus comprises a housing 9, a d.c. electric motor 2 attached to the housing and having an armature rotary shaft 2a, an output rotary shaft (not shown) with a pinion (not shown) engageable with an engine ring gear (not shown), and a planetary speed reduction gear 5 disposed within the housing 9 between the armature rotary shaft 2a and the output rotary shaft.

The planetary speed reduction gear 5 comprises a sun gear 11 mounted to the armature rotary shaft 2a, an internal gear 20 made of a resin material and concentrically disposed around the sun gear 11 with an annular space defined therebetween, a plurality of planetary gears 12 disposed between the sun gear 11 and the internal gear 20 and each engaged with the sun gear 11 and the internal gear 20, and a planetary gear carrier 13 connected to the output rotary shaft and rotatably supporting the planetary gears 12.

The internal gear 20 comprises a ring-shaped internal gear member 20a having an inner circumferential surface and an outer circumferential surface, and a reinforcing member for elastically supporting the outer circumferential surface of the internal gear member 20a, thereby to increase rigidity of the internal gear member 20a.

In the embodiment illustrated in FIGS. 1 to 4, the reinforcing member comprises a thin-wall, substantially cylindrical member 22 concentrically disposed around the internal gear member 20a with an annulus defined therebetween, and a large number of ribs 21 radially and axially extending between the outer circumferential surface of the internal gear member 20a and the cylindrical member 22 for integrally connecting them together.

Thus, the internal gear member 20a made of a suitable resin material has integrally formed on its outer circumferential surface a large number of radial ribs 21, of which outer ends are integrally connected by a thin cylindrical member 22.

Figure 4:
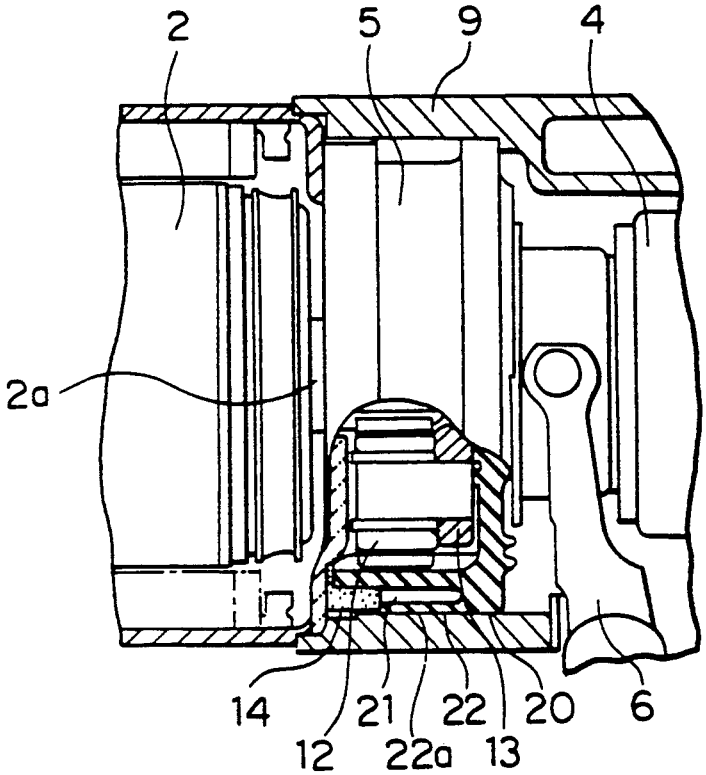
FIG. 4 is a side view of a part of the starter apparatus shown in FIG. 1.

Further, the thickness of the radial ribs 21 is made substantially equal to the thickness a of the thin cylinder 22 and is made smaller than the dimension b between the outer diameter of the internal gear member 20a and the root of the ribs 21 (see FIG. 1). Also, it is desirable that a small clearance 22a is formed between the outer peripheral surface of the thin cylinder 22 and the inner surface of the housing 9 (FIG. 4). This small clearance is preferably 0.1~0.5% of the outer diameter of the internal gear 20. Also, the axial length of the ribs 21 and the thin cylinder 22 are made longer than ½ of the length dimension over which they are in engagement with the planetary gears 12 and a packing 14 is provided at the step portion with no rib 21.

The reason that the entire portion of the ribs 21 and the thin cylinder 22 are not filled with resin is that if the entire portion is made of resin, the roundness of the gear of the internal gear 20 is lost due to influences of notches 23 necessary for allowing through bolts to extend therethrough.

Figure 7:
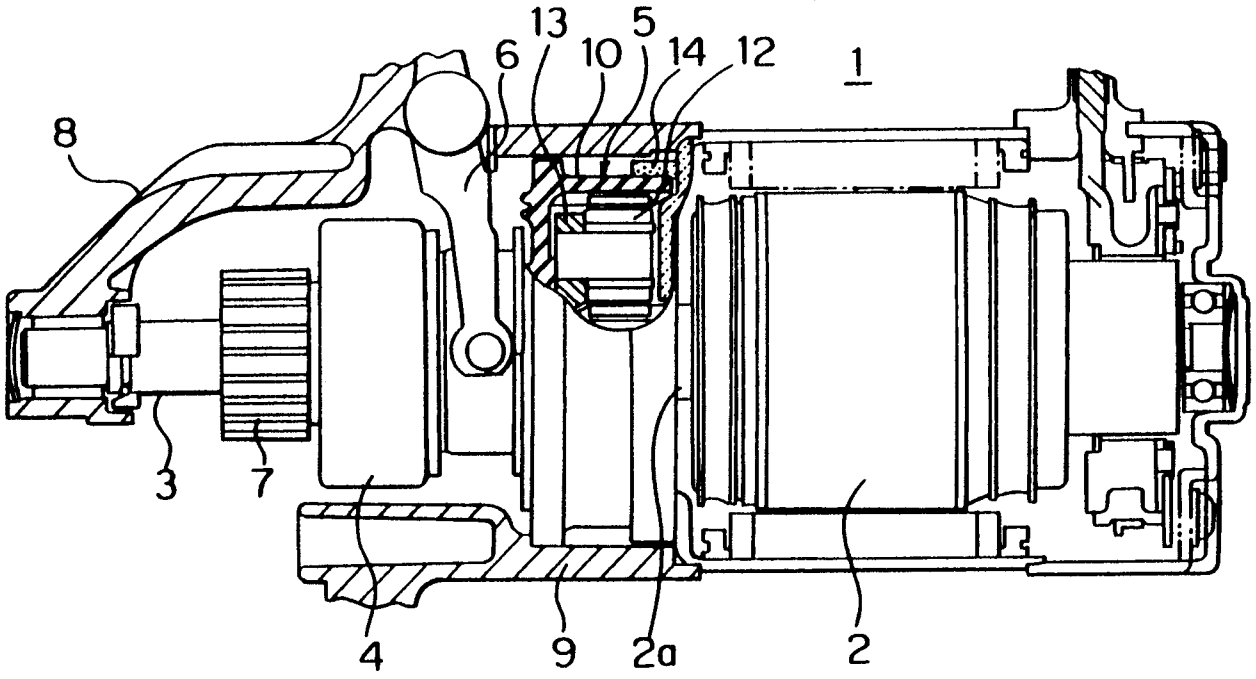
FIG. 7 PRIOR ART
Figure 8:
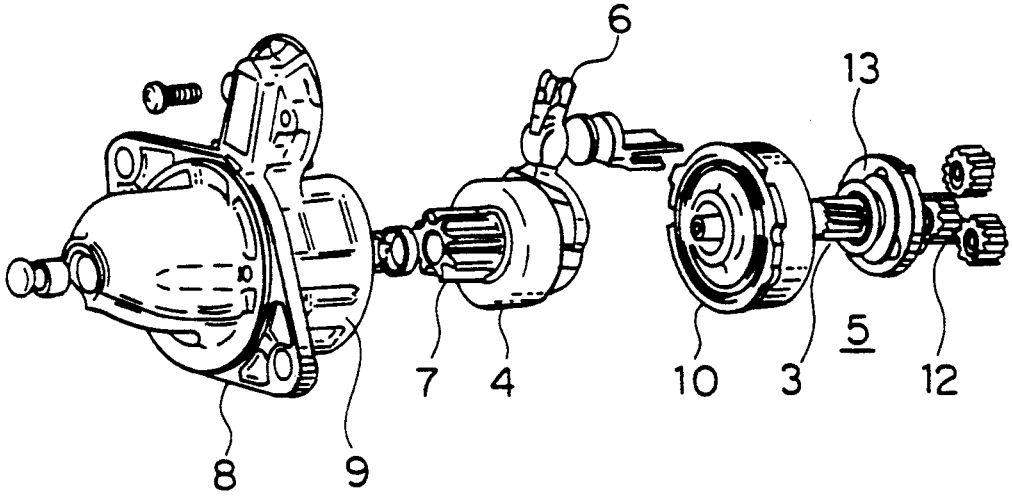
FIG. 8 PRIOR ART
Figure 9:
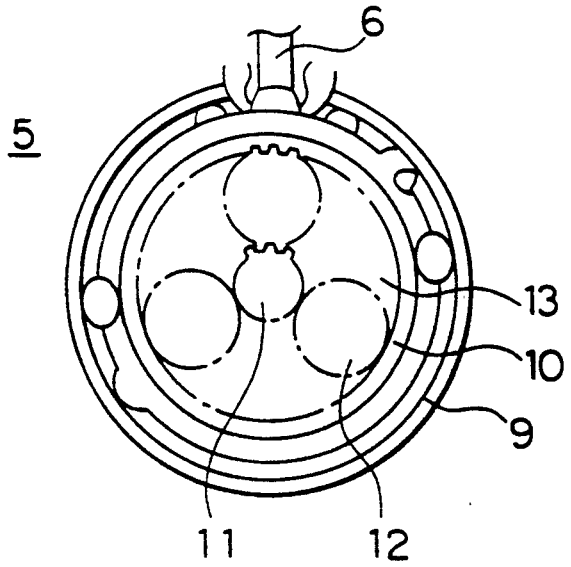
FIG. 9 PRIOR ART

The other reference numerals identical to those used in FIGS. 7~9 designate the same or similar components.

With the above construction, the ribs 21 and the thin cylinder 22 reinforce the internal gear 20 to increase its strength by about 20%. Therefore, even if a massive load is applied to the planetary gear speed reduction means 5 upon the rotation of the armature rotary shaft, the deformation of the internal gear 20 is prevented and the internal gear 20 is not damaged.

Further, as an additional function and results, the frictional heat generated in the planetary gear speed reduction means 5 can be dissipated by conduction to the exterior because only a portion of the gap is filled with the resin material, whereby the temperature rise in the internal gear 20 is suppressed, eliminating the fear that the internal gear 20 is damaged by heat.

Also, since there are many vacant openings at the outside of the engagement portion of the internal gear 20, a large sound attenuation is obtained in this portion, providing a noise suppressing effect.

Further, the small clearance 22a defined by the housing 9 allows the internal gear 20 to deform by a suitable amount, ensuring uniform distribution of the load to prevent local damages by distributing the load. Also, an advantageous result is obtained that the internal gear 20 is prevented from being subjected to an abnormal force due to a difference in coefficient of thermal linear expansion upon the temperature change.

Figure 5:
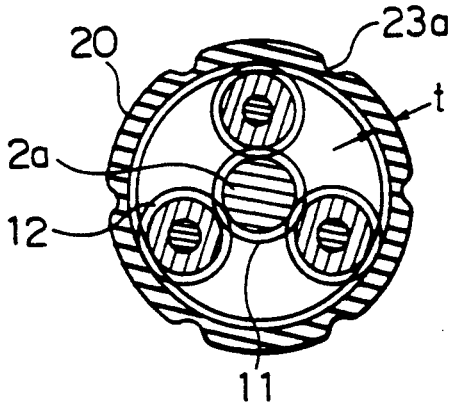
FIG. 5 is a front view of the main portion of another embodiment of the starter apparatus of the present invention.

FIG. 5 illustrates another embodiment, in which the internal gear 20 of the embodiment illustrated in FIGS. 1~4, which has a cylinder thickness t of the gear portion, a plurality of notches 23a corresponding to spaces through which the through bolts pass are provided at equal intervals along the circumference. With such a construction, the precision of the gear can be advantageously made constant in addition to the previously described advantages.

Figure 6:
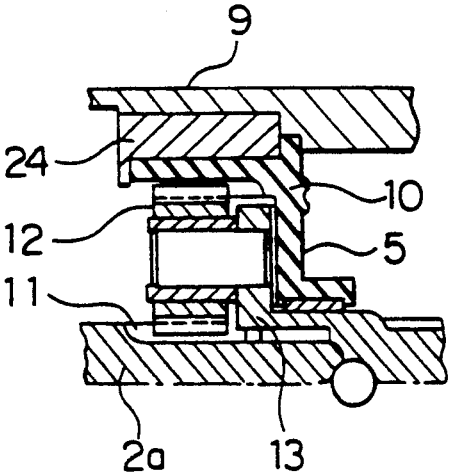
FIG. 6 is a sectional side view illustrating still another embodiment of the starter apparatus of the present invention.

FIG. 6 illustrates one embodiment of the second invention, in which the internal gear 10 of the planetary speed reduction gear 5 which is similar to that of the conventional design has provided between the internal gear 10 and the housing 9 a cylindrical elastic member 24. With the above structure, the deformation of the internal gear 10 due to a large load can be suppressed by the cylindrical elastic member 24.

As has been described, according to one embodiment of the present invention, since a large number of ribs are formed on the outer circumference of the internal gear member and the outer ends of the ribs are connected by the thin cylinder, the deformation and damage due to a large load can be prevented. Also, the damage of the internal gear by heat is prevented and noise is advantageously reduced.

Further, according to another embodiment of the present invention, the cylindrical elastic member is inserted between the internal gear member and the housing, so that the deformation of the internal gear member due to a large load can be prevented.

What is claimed is:

1. An engine starter apparatus, comprising:

a housing;

a d.c. electric motor attached to said housing and having an armature rotary shaft;

an output rotary shaft with a pinion engagable with an engine ring gear; and a planetary speed reduction gear disposed within said housing between said armature rotary shaft and said output rotary shaft, said planetary speed reduction gear including a sun gear mounted to said armature rotary shaft, an internal gear made of a resin material and concentrically disposed around said sun gear with an annular space defined therebetween, a plurality of planetary gears disposed between said sun gear and said internal gear and each engaged with said sun gear and said internal gear, and a planetary gear carrier connected to said output rotary shaft and rotatably supporting said planetary gears;

said internal gear comprising a ring-shaped internal gear member having an inner circumferential surface and an outer circumferential surface, and means for absorbing a load placed upon said internal gear to prevent deformation of said internal gear, said means comprising reinforcing means for elastically supporting said outer circumferential surface of said internal gear member, thereby to increase rigidity of said internal gear member, wherein said reinforcing means comprises a thin-wall, substantially cylindrical member concentrically disposed around said internal gear member with an annulus defined therebetween, and a plurality of ribs radially and axially extending between said outer circumferential surface of said internal gear member and said cylindrical member for integrally connecting said outer circumferential surface of said internal gear and said cylindrical member together, said ribs having an axial length which is less than an axial length of said cylindrical member, wherein said thin-wall cylindrical member and said housing define therebetween a small radial gap, the ribs being disposed evenly on the entire outer circumferential surface of the internal gear such that deformation of the internal gear during driving of the planetary speed reduction gear is uniform in accordance with the number of the planetary gears.

2. An engine starter apparatus as claimed in claim 1, wherein said ribs each have a thickness substantially equal to a thickness of said thin-wall cylindrical member and smaller than a radial dimension of said internal gear member between a dedendum circle of the internal gear and said outer circumferential surface of said internal gear member.

3. A starter apparatus as claimed in claim 1, wherein said small radial gap is from 0.1% to 0.5% of an outer diameter of said internal gear member.

4. A starter apparatus as claimed in claim 1, wherein said ribs and said thin-wall cylindrical member have an axial length sufficient for covering at least an axial length corresponding to one half of an axial length of a meshing area in which said planetary gears are in mesh with said internal gear member.

5. A starter apparatus as claimed in claim 4, wherein a packing material is filled between the other half of said axial length of said meshing area of said internal gear member and said housing.

6. A starter apparatus as claimed in claim 1, wherein said reinforcing means has formed therein an axial groove for allowing a through bolt for connecting said housing and said d.c. motor to pass therethrough.

* * * * *